US005285774A

United States Patent [19]

Stachurski

[11] Patent Number: 5,285,774

[45] Date of Patent: Feb. 15, 1994

[54] NAPE AND SCALP STIMULATOR

[76] Inventor: Stephen A. Stachurski, 1221 Ocean Pines, Berlin, Md. 21811

[21] Appl. No.: 944,936

[22] Filed: Sep. 15, 1992

[51] Int. Cl.[5] ..... A61H 11/00

[52] U.S. Cl. ..... 128/62 R; 128/60; 132/129; 132/132; 132/148

[58] Field of Search ..... 128/59, 60, 61, 62 R, 128/67; 132/129, 132, 141, 142, 148, 159, 219, 212

[56] References Cited

U.S. PATENT DOCUMENTS

| | | | |
|---|---|---|---|
| 974,367 | 11/1910 | Dunder . | |
| 1,382,436 | 6/1921 | Malm | 128/62 R |
| 1,523,979 | 1/1925 | Ryan et al. | 128/62 R |
| 1,554,510 | 9/1925 | Kirby | 128/62 R |
| 1,605,959 | 11/1926 | Lefevre | 128/60 |
| 1,713,756 | 5/1929 | Hassler | 128/62 R |
| 1,726,560 | 9/1929 | Hassler | 128/67 |
| 1,997,944 | 4/1935 | Ogdent, Jr. et al. . | |
| 2,075,413 | 3/1937 | Welker | 128/62 R |
| 2,175,344 | 10/1939 | Friedman . | |
| 2,505,005 | 4/1950 | Reiter . | |
| 2,944,273 | 7/1960 | Harris | 128/60 |
| 2,984,248 | 5/1961 | Sidelman . | |
| 3,107,665 | 10/1963 | Nordgren | 128/62 R |
| 3,519,003 | 7/1970 | Mizel . | |

FOREIGN PATENT DOCUMENTS

| | | | |
|---|---|---|---|
| 1223438 | 6/1960 | France | 128/60 |
| 921098 | 3/1963 | United Kingdom | 128/60 |

OTHER PUBLICATIONS

Photocopied Image of "Goody" Scalp Massaging Brush on sale in U.S.A. Prior to Sep. 1, 1991,

*Primary Examiner*—Gene Mancene
*Assistant Examiner*—Frank A. LaViola
*Attorney, Agent, or Firm*—Richard C. Litman

[57] ABSTRACT

A nape and scalp stimulator for use in simultaneously massaging both sides of the nape of the human neck is disclosed. The stimulator includes: an elongated body having a top and a bottom surface as well as a peripheral rim extending between said surfaces, a plurality of narrow teeth integral with the body and depending from its bottom surface. Two rotatable T-shaped handles for retaining the stimulator within the hands of the user are joined to the stimulator body and extend from the top surface thereof. In an alternative embodiment of the stimulator, a hinge is provided within the elongated body thereby permitting adjacent stimulator elements to pivot relative to one another.

16 Claims, 2 Drawing Sheets

NAPE AND SCALP STIMULATOR

FIELD OF THE INVENTION

The present invention relates generally to toilet articles and is particularly directed toward a massaging and stimulating implement of the comb type.

BACKGROUND OF THE INVENTION

Home remedies for the treatment of male pate baldness have been used for years. Generations of men attempting to retain their hair, and a youthful appearance as dictated by the fashion of the day, have tried numerous techniques to hinder or reverse natural hair loss. Lotions, elixirs, tonics and the like have been applied to the scalps of thousands. Strict dietary and exercise regimens have been undertaken by others. Special scalp massaging techniques and massaging tools have also been utilized. Little success, however, has been achieved in hindering or reversing the loss of hair from a gentleman's head.

DESCRIPTION OF THE RELATED ART

Despite a lack of clinical data substantiating claims of hair restoration upon bald heads, scalp massaging and stimulating tools have retained a strong position within the toiletries market. Possibly the reason for the solid consumer demand for such devices is not their unproven ability to prevent or reverse hair loss, but their acknowledged and well-known capacity to improve personal hygiene. Additionally, some individuals content that the use of massaging tools by their very nature just feels good. Whatever the consumer's ultimate purpose in acquiring these devices, however, it is not unheard of that some stores have found it difficult to keep them stocked.

As the desire to improve one's general health has not been isolated to the current generation, numerous scalp massaging tools are found in the patent record. By way of example, U.S. Pat. No. 974,367, issued Nov. 1, 1910 to Anna M. Dunder, shows a comb having hollow teeth and partially exposed massaging rollers fitted within the distal ends thereof. Additionally, U.S. Pat. No. 1,997,944, issued Apr. 16, 1935 to Alexander F. Ogden, Jr. et al, provides a massaging comb having a plurality of circularly arranged teeth and a compartment for automatically delivering tonic, shampoo, or the like to the scalp as the comb is being used. Further, U.S. Pat. No. 2,175,344, issued Oct. 10, 1939 to Joseph Friedman, describes a massaging comb having two groups of teeth. One such group of teeth has ends or tips with alternating, opposed inclinations for the loosening and removal of dandruff. The remaining teeth are fitted with round knobs at their ends for massaging and stimulating the scalp. U.S. Pat. No. 2,505,005, on the other hand, issued Apr. 25, 1950 to Adolph Reiter, discloses a flexible and resilient scalp massaging and treating tool, the teeth thereof capable of bending in accordance with the shape of the scalp over which it is passed. In the preferred embodiment, the tool comprises a thin metallic sheet, like strips extending therefrom serving as teeth. None of the above inventions and patents, taken either singly or in combination, is seen to describe the instant invention as claimed.

SUMMARY OF THE INVENTION

The principal object of the invention is to provide a massaging tool having a plurality of resilient teeth and of such construction so as to conform to the rounded contour of nape of a human neck when in use.

It is a further object of the invention to provide a massaging tool with a plurality of handles which may be easily grasped by one or both hands of the user when such is employed for massaging purposes.

It is another object of the invention to provide a tool which may be effectively utilized as massaging implement for the skin covering the top of the human head or scalp.

It is an additional object of the invention to providing a massaging and stimulating implement to help circulation, relax muscles, and accelerate physiological activity of the user.

Still another object of the invention is to provide a massaging article of simple construction, which is efficient in performance, relatively inexpensive to manufacture and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
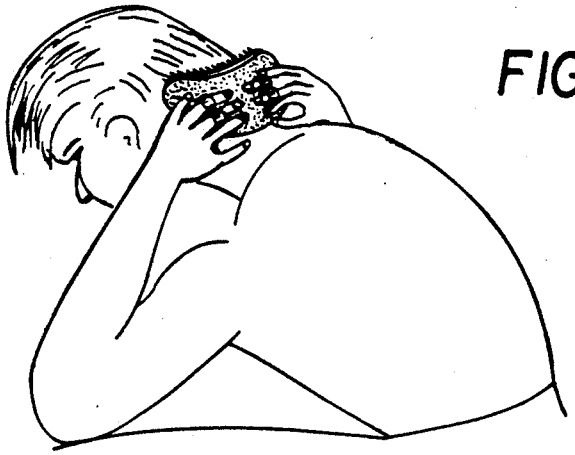
FIG. 1 is a view of an individual using a nape and scalp stimulator in accordance with this invention.
Figure 2:
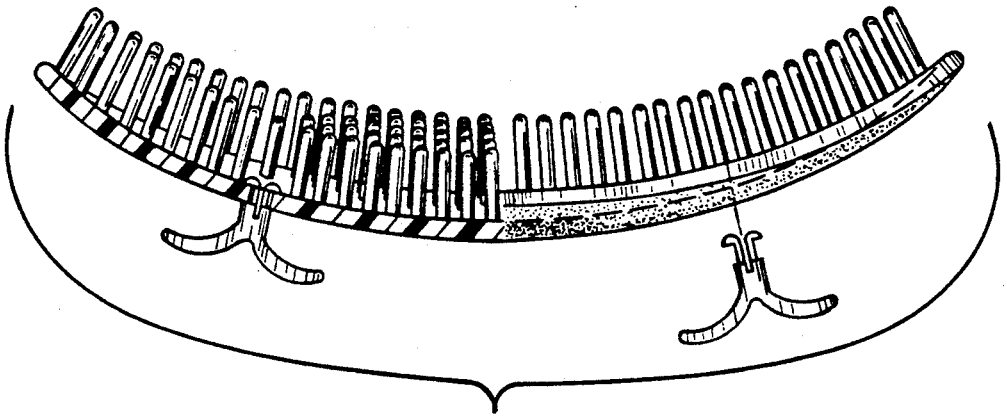
FIG. 2 is a side view of the stimulator of FIG. 1 partially sectioned to show detail.
Figure 3:
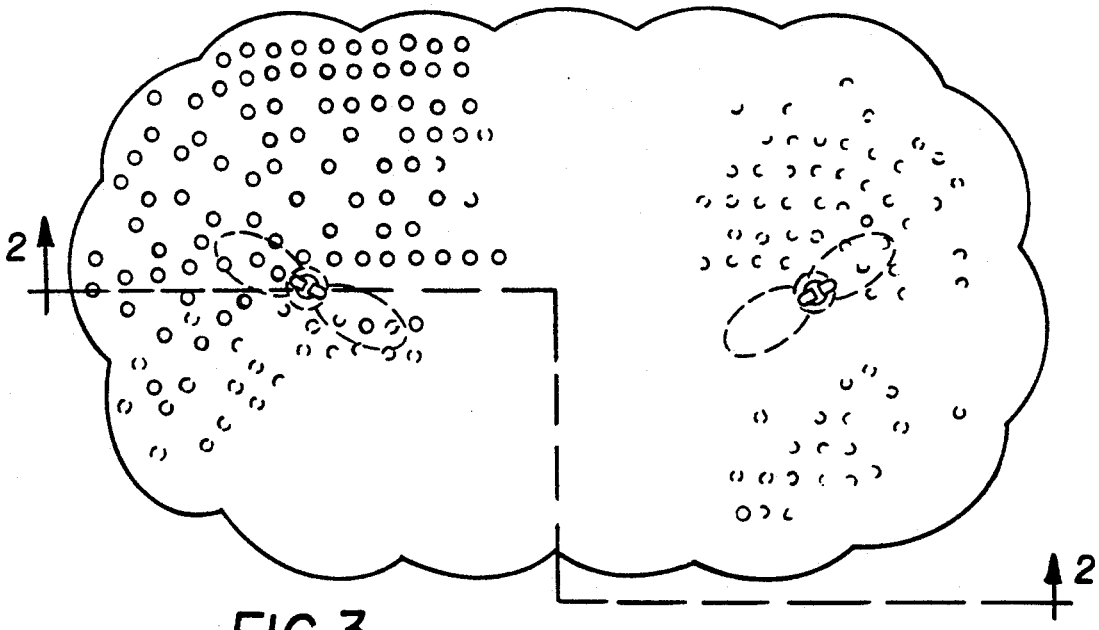
FIG. 3 is a bottom view of the stimulator of FIG. 1.

Referring now to the embodiment of the invention shown in FIGS. 1, 2, and 3 by way of example only, a nape and scalp stimulator 10 may be seen comprising an elongated base or body 12 provided with a plurality teeth 14 substantially evenly spaced about the bottom of body 12. Two T-shaped handles 16 removably jointed to, and projecting from the top of, body 12 may also be seen. Fabrication of stimulator 10 preferably is of flexible and resilient plastic or rubber molded, or otherwise formed, with the desired configuration.

The base or body 12 of stimulator 10 may be seen in FIG. 2 to comprise a relatively thin sheet having a concave arcuate cross-section relative to any plane bisecting body 12 and passing through the center thereof. Body 12 has a top surface 15, a bottom surface 17, and a peripheral rim 19 extending between said top and bottom surfaces. Body 12 is generally elongated or lengthened along an axis passing through holes 18 provided in body 12 for the attachment of handles 16. This elongated configuration is necessary to allow both sides of the nape of the neck to be simultaneously massaged by stimulator 10 when in use. A device having a substantially circular or square configuration would be unsatisfactory for massaging the nape of the neck as its diameter or length of side, substantially limited by the length of the human neck, would not permit both sides of the neck to be massaged simultaneously. Additionally, body 12 is provided with an overall U-shaped appearance when viewed from the side and best seen in FIG. 2. This U-shape permits stimulator 10 to readily conform to the curvature of various parts of the user's body and especially the nape of the neck. Although body 12 is preferably provided during its manufacture with a concaved and U-shaped structure, it is envisioned that body 12 could readily be formed as a substantially flat sheet having a similar thickness. As the preferred construction materials for stimulator 10 provide both resilience and flexibility, said flat sheet could be readily bent with light pressure to conform to the contours of the neck or other curved areas of the user's body, and when not in use would return to a flat configuration for easy storage upon a shelf, etc. Surface decoration may be added to the lateral edges of body 12 such as scallops 21 or a raised bead (not shown). Such decorative elements are of some functional utility in that they add a certain amount of structural rigidity to the device in a tasteful manner. A plurality of teeth 14 are joined to body 12 and provide the massaging action when stimulator 10 is used. Each tooth 14 is substantially round in cross-section and forms a cylinder as it tapers from its root 20 to its tip 22 and is of the same length. It is to be understood that teeth 14 may comprise other geometric configurations such as: cones, pyramids, and rectangular solids, and need not be limited to a substantially cylindrical shape in order to achieve the objects of the invention as hereinbefore described. Teeth 14 are shown in the FIG. 3 as being arranged in rows circling holes 18 of body 12. Any arrangement of teeth 14, however, may be acceptable provided that teeth 14 are not so greatly spaced apart so as to permit the bottom surface of body 12 to contact the skin of the user when stimulator 10 is used. Teeth 14 may be integrally formed with body 12, depending from bottom surface 17, during the molding thereof or otherwise formed as separate components and attached to body 12 during manufacturing. Teeth 14, comprised of a flexible and resilient material, are capable of bending slightly when drawn across the skin and springing back to an upright stance when withdrawn therefrom.

Two T-shaped handles 16 are removably joined to body 12. Each handle has a finger retaining portion 24 and fastener portion 26. Finger retaining portion 24 is defined by a substantially rigid upright shaft 25 for making contact with the top of body 12 and two opposing and curved flanges 28, one for retaining two fingers of a hand when in use. Shaft 25 has a substantially round cross-section with an area greater than that presented by attachment holes 18 in body 12 thereby preventing shaft 25 from entering hole 18. Each flange 28, when viewed from the side as may best be seen in FIG. 2, may be seen to comprise the segment of a circle or arc whose defining radius is roughly equivalent to the radius of the index or middle fingers of the adult human. Obviously, this radius should not to be considered as a limiting factor in that the size of flange 28 may be varied to suit children by reduction or varied to suit larger adults by increase. The size indicated, however, should be suitable to the majority of intended users of stimulator 10. Joined to shaft 25, fastener portion 26 comprises two opposed semicircular stems 29 spaced from one another, each semicircular stem 29 having a cross-section substantially equivalent to one half of a circle and a length equal to the thickness of body 12. Stems 29 may be moved into contact with one another by a small force thereby presenting a projection from shaft 25 having a circular cross-section whose diameter is less than that of attachment holes 18. At the distal end of each stem 29 is a flared lip or catch 30 each having a cross-sectional configuration similar to that of the stem to which each is attached. Whereas stems 29 may be urged together to form a projection of circular cross-section smaller in diameter than holes 18, catches 30 when urged together present a circular projection with a diameter substantially equivalent to that of hole 18. Once fastener portion 26 is urged into hole 18 of body 12, until stopped in its travel by shaft 25, catches 30, joined to stems 29, will spring apart thereby joining handle 16 to body 12. In this arrangement, handle 16 may turn freely relative to body 12 upon the axle formed by stems 29. In an alternative mounting arrangement, handles 16 may be formed integrally with body 12 thereby eliminating the need for fastener portion 26 of handle 16 and holes 18 in body 12.

Figure 4:
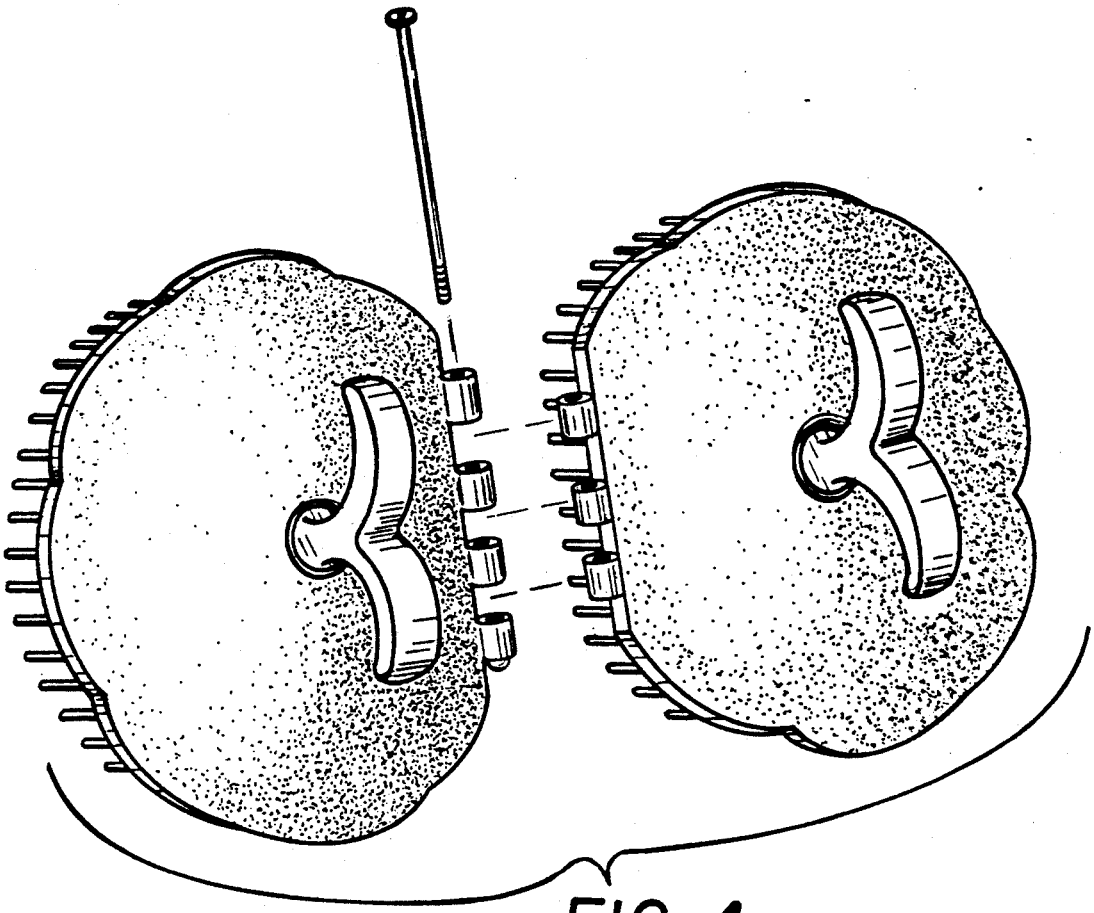
FIG. 4 is an exploded perspective view of a second embodiment of a nape and scalp stimulator.
Figure 5:
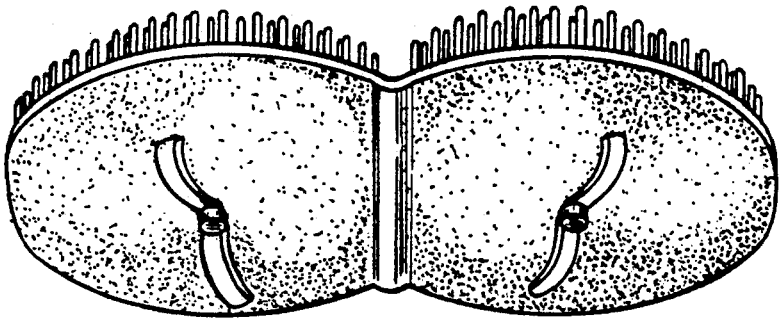
FIG. 5 is a perspective view of a third embodiment of a nape and scalp stimulator.

FIG. 4 illustrates a second embodiment of the invention having a hinge 32 joining two similarly shaped stimulator elements 34. Each stimulator element 34 is provided with a body 36, teeth 38, and a handle 40 being substantially the same, in terms of structure and function, as their corresponding component in the embodiment shown in FIGS. 1–3. Upon close inspection of FIG. 4, however, several subtle differences between the two embodiments become apparent. First, each body 36 is substantially circular, rather than elongate, in configuration and has a single handle 40. As may be seen in FIG. 4, each stimulator element 34 comprises a thin sheet having a concave arcuate cross-section relative to any plane bisecting said stimulator element and passing through the center thereof. Only when body segments 36 are joined by hinge 32, does the second embodiment of the inventive stimulator achieve its desired elongated and bi-handled configuration. Hinge 32 permits the stimulator to conform to the contours of the body of the user and the nape of the human neck in particular. Various hinge types may be incorporated into the instant stimulator, each permitting body segments 36 to turn or pivot toward one another. Mechanical hinge 32 has staggered and interlocking loops 42 pivotally joined by rod 44 when inserted therebetween. A second hinge embodiment is shown in FIG. 5 and comprises a thin, flexible, integral sheet 43 joining body segments 46 and is perhaps superior to hinge 32 in that it is inexpensive to manufacture and less likely to experience mechanical failure.

To utilize the inventive stimulator for its intended purposes, the user must bow his or her head forward toward the chest until a comfortable orientation is reached without strain. It is further recommended, but not required, that the user assume a crouched position by flexing the knees somewhat and bending the torso forward at the waist to derive the maximum benefit from the stimulator's use. A crouched position may be obtained, alternatively, by leaning the upper body forward while seated in a comfortable chair. It is believed that from this position, blood circulates more freely to the upper portion of the human frame and that muscles in the neck and back become relaxed.

Once or twice a day, using a vigorous reciprocating motion up and down upon the nape or back of the neck with a medium pressure, the stimulator is drawn against the user's skin. Generally, the distance covered by each stroke measures from immediately below the earlobes to the upper portion of the back or approximately four inches (ten centimeters). Usually, only one hundred strokes are necessary to achieve the desired result and require less than one minute to perform. If done properly, the stimulated skin will be somewhat flushed with blood and the nerve cells therein transmitting a pleasing sensation to the brain.

Use of the nape and scalp stimulator in the manner hereinbefore described has had the effect in some individuals of reducing hair loss from the top of the head. Clinical studies have not been performed to confirm the effectiveness of the instant invention in preventing such loss in large groups of individuals. Nevertheless, it is believed that the effectiveness of the invention lies in the fact that, during its use, blood flow to the scalp is encouraged by the lowering of the head relative to the elevation of the heart of the user thereby permitting a greater flow of blood and nourishment to the individual hair follicles. Further, the user's assumption of a comfortable and relaxed position while the stimulator is employed, thereby reducing bodily tension, could do no harm.

Just as the nape of the neck may be massaged by the instant stimulator, other portions of the body may be similarly treated. The scalp, legs, arms, and torso of the user may be massaged to great effect. By rubbing the scalp itself, dandruff and other foreign matter lodged within the hair may be removed. Dead skin cells may removed from other portions of the body through the use of the device. Obviously, these hygienic activities may be facilitated by employing the instant stimulator in the shower or in the bath tub with soap or shampoo. As the preferred embodiment of the device is constructed of resilient plastic, soap and water will have no detrimental effect upon the device.

It is to be understood that the present invention is not limited to the sole embodiment described above, but encompasses any and all embodiments within the scope of the following claims.

I claim:

1. A nape and scalp stimulator, comprising:
an elongated body having a top and a bottom surface as well as a peripheral rim extending between said surfaces, said elongated body having a length dimension longer than its width dimension;
a plurality of narrow teeth integral with said body and depending from said bottom surface;
a plurality of T-shaped handles joined to said body and extending from said top surface for applying direct pressure to said top surface of said elongated body;
each of said handles further comprising:
a finger retaining portion including:
a substantially rigid shaft contacting said top surface; and
a curved flange joined to the top of said shaft adapted to hold said stimulator against a human hand while in use;
a fastener portion for rotatably joining said handle to said body including:
two opposed semicircular stems laterally spaces from one another and joined to the bottom of said shaft, said stems adapted to be inserted through a hole provided in said body for that purpose; and
a flared catch extending from the distal end of each said stem for retaining said handle against said body when said stems are inserted into said hole whereby said handle is free to turn relative to said body.

2. The nape and scalp stimulator according to 1 wherein said elongated body further comprises:
a thin sheet having a concave arcuate cross-section relative to any plane bisecting said body and passing through the center thereof.

3. The nape and scalp stimulator according to claim 2 wherein said sheet further has a U-shaped configuration whereby said stimulator will simultaneously massage both sides of the nape of the human neck when in use.

4. The nape and scalp stimulator according to claim 1 wherein said teeth have a substantially cylindrical shape.

5. The nape and scalp stimulator according to claim 4 wherein said elongated body further includes:
a thin sheet having a concave arcuate cross-section relative to any plane bisecting said body and passing through the center thereof.

6. The nape and scalp stimulator according to claim 5 wherein said sheet further has a U-shaped configuration whereby said stimulator will simultaneously massage both sides of the nape of the human neck when in use.

7. The nape and scalp stimulator according to claim 6 comprising a resilient and flexible plastic material.

8. A nape and scalp stimulator for use in simultaneously massaging both sides of the nape of the human neck, comprising:
an elongated body including:
a first stimulator element;
a second stimulator element hingedly joined to said first stimulator element; and
means for hingedly joining said first and second stimulator elements;
a plurality of flexible and resilient teeth joined to said first and second stimulator elements;
a T-shaped handle joined to each said stimulator element and extending from the top thereof;
each said handle further comprising:
a finger retaining portion including:
a substantially rigid shaft contacting one said stimulator element; and
a curved flange joined to the top of said shaft adapted to hold said stimulator against a human hand while in use;
a fastener portion for joining said handle to one said stimulator element including:
two opposed semicircular stems laterally spaced from one another and joined to the bottom of said shaft, said stems adapted to be inserted through a hole provided in said stimulator element for that purpose; and
a flared catch extending from the distal end of each said stem for retaining said handle against said stimulator element when said stems are inserted into said hole.

9. The nape and scalp stimulator according to 8 wherein each said stimulator element further comprises:
a thin sheet having a concave arcuate cross-section relative to any plane bisecting said stimulator element and passing through the center thereof.

10. The nape and scalp stimulator according to claim 8 wherein said teeth have a substantially cylindrical shape.

11. The nape and scalp stimulator of claim 8 comprised of a resilient and flexible plastic material.

12. The nape and scalp stimulator according to claim 8 wherein said means for hingedly joining said first and second stimulator elements comprises:
a plurality of interlocking loops integral with and depending from said first and second stimulator elements; and a rod inserted through said loops for retaining said stimulator elements in a side-by-side orientation.

13. The nape and scalp stimulator according to claim 12 wherein each said stimulator element further comprises:

a thin sheet having a concave arcuate cross-section relative to any plane bisecting said stimulator element and passing through the center thereof.

14. The nape and scalp stimulator according to claim 8 wherein said means for hingedly joining said first and second stimulator elements comprises:

a flexible sheet integral with said first and second stimulator elements retaining said stimulator elements in a side-by-side orientation.

15. The nape and scalp stimulator according to claim 14 wherein each said stimulator element further comprises:

a thin sheet having a concave arcuate cross-section relative to any plane bisecting said stimulator element and passing through the center thereof.

16. A nape and scalp stimulator, comprising:

an elongated body including:

a first stimulator element formed from a resilient and flexible plastic material having a concave arcuate cross section relative to any plane bisecting said first stimulator element and passing through the center thereof;

a second stimulator element formed from a resilient and flexible plastic material having a concave arcuate cross section relative to any plane bisecting said second stimulator element, said second stimulator element hingedly joined to said first stimulator element; and means for hingedly joining said first and second stimulator elements, said hinge means including:

a plurality of interlocking loops integral with, and depending from, said first and second stimulator elements; and a rod inserted through said loops for retaining said stimulator elements in a side-by-side orientation;

a plurality of flexible and resilient teeth having a substantially cylindrical shape integrally joined to said first and second stimulator elements;

a T-shaped handle joined to each said stimulator element and extending from the top thereof, each said handle further including:

a finger retaining portion including:

a substantially rigid shaft contacting one said stimulator element; and a curved flange joined to the top of said shaft adapted to hold said stimulator against a human hand while in use;

a fastener portion for joining said handle to one said stimulator element including:

two opposed semicircular stems laterally spaced from one another and joined to the bottom of said shaft, said stems adapted to be inserted through a hole provided in said stimulator element for that purpose; and a flared catch extending from the distal end of each said stem for retaining said handle against said stimulator element when said stems are inserted into said hole.

* * * * *